US005174869A

United States Patent [19]

Uesugi et al.

[11] Patent Number: 5,174,869

[45] Date of Patent: Dec. 29, 1992

[54] METHOD OF PRODUCING ALUMINUM SUPPORT FOR PRINTING PLATE

[75] Inventors: Akio Uesugi; Tsutomu Kakei, both of Shizuoka, Japan

[73] Assignee: Fuji Photo Film Co., Ltd., Kanagawa, Japan

[21] Appl. No.: 846,778

[22] Filed: Mar. 9, 1992

Related U.S. Application Data

[63] Continuation of Ser. No. 570,562, Aug. 21, 1990.

[30] Foreign Application Priority Data

Aug. 21, 1989 [JP] Japan ..... 1-212998

[51] Int. Cl.[5] ..... C25F 3/04

[52] U.S. Cl. ..... 204/129.43; 204/129.75

[58] Field of Search ..... 204/129.43, 129.75

[56] References Cited

U.S. PATENT DOCUMENTS 4,087,341 5/1978 Takahashi et al. ..... 204/129.43
4,476,006 10/1984 Ohba et al. ..... 204/129.43
4,561,944 12/1985 Sasaki et al. ..... 204/129.43
4,576,686 3/1986 Hirokazu et al. ..... 204/129.43
4,686,021 8/1987 Nakanishi et al. ..... 204/129.75
4,919,774 4/1990 Minato et al. ..... 204/129.43

FOREIGN PATENT DOCUMENTS 1169234 10/1969 United Kingdom .

*Primary Examiner*—John Niebling
*Assistant Examiner*—Kishor Mayekar
*Attorney, Agent, or Firm*—Sughrue, Mion, Zinn, Macpeak & Seas

[57] ABSTRACT

A method of producing an aluminum support for a printing plate by electrochemical graining. The aluminum support is soaked in an acid electrolytic liquid of nitric acid or hydrochloric acid in preferred ranges. An alternating current including a $t_F$ positive period and a $t_R$ negative period is applied between the aluminum support and an opposite electrode, with current reach peak levels in the positive period $t_F$ and the negative period $t_R$ being reached within the initial range of 0.1-20% of either period.

8 Claims, 1 Drawing Sheet

METHOD OF PRODUCING ALUMINUM SUPPORT FOR PRINTING PLATE

This is a continuation of application Ser. No. 07/570,562 filed Aug. 21, 1990.

BACKGROUND OF THE INVENTION

This invention relates to a method of producing an aluminum support for a printing plate, and more particularly to a method of producing a grained aluminum support for an offset printing plate.

Conventionally, an aluminum plate (including aluminum alloy) has been used as a printing plate, such as an offset printing plate. Usually, in offset printing, it is necessary to apply a suitable adhesion and a suitable amount of water between the surface of the aluminum plate and a photosensitive layer.

The surface of the aluminum plate should be uniformly and finely grained to meet the aforesaid requirements. This graining process largely affects a printing performance and a durability of the printing plate upon the printing process following manufacture of the plate. Thus, it is important for the manufacture of the plate whether such graining is satisfactory or not.

In general, an alternating current electrolytic graining method is used as the method of graining an aluminum support for a printing plate. There are a variety of suitable alternating currents, for example a sinewaveform, a squarewaveform, a special alternating waveform and the like. When the aluminum support is grained by alternating current supplied between the aluminum plate and an opposite electrode such as a graphite electrode, this graining is usually conducted only one time, as the result of which, the depth of pits formed by the graining is small over the whole surface thereof. Also, the durability of the grained printing plate during printing will deteriorate. Therefore, in order to obtain a uniformly and closely grained aluminum plate satisfying the requirement of a printing plate with deep pits as compared with their diameters, a variety of methods have been proposed as follows.

One method is a graining method to use a current of particular waveform for an electrolytic source (Japanese Patent Laid-Open No. Sho 53-67507). Another method is to control a ratio between an electricity quantity of a positive period and that of a negative period at the time of alternating electrolytic graining (Japanese Patent Laid-Open No. Sho 54-65607). Still another method is to control the waveform supplied from electrolytic source (Japanese Patent Laid-Open No. Sho 55-25381). Finally, another method is directed to a combination of current density (Japanese Patent Laid-Open No. Sho 56-29699).

Additionally, Japanese Patent Examined Publication No. Sho 61-60797 discloses obtaining a uniform graining surface as a result of supplying an alternating current to the aluminum plate, in which at least one of the positive period and negative period includes a rest period of 0 Volt, so that the electricity quantity of the positive period may be larger than that of the negative period.

However, in the case of using an alloy containing a large variety of ingredients for the aluminum plate, such as JIS3003 material, an irregular yield of a small amount of ingredients among aluminum lots is likely to transform the graining form and to change the printing performance.

Although the methods disclosed in the above publications satisfy the requirements for uniform pits, more satisfactory printing performance and more uniform pits have recently been required.

SUMMARY OF THE INVENTION

An object of this invention is to provide a method of producing an aluminum support for a printing plate by using an electrolytic treatment and a current waveform, and in which an aluminum plate is more uniformly grained, resulting in stable quality for printing performance despite the irregular variations of a small amount of ingredients within the aluminum composition.

Namely, the foregoing object of the invention has been achieved by the provision of a method of producing an aluminum support for a printing plate by electrochemical graining, comprising steps of: soaking the aluminum support in an acid electrolytic liquid; and assuming that $t_F$ is the positive period and $t_R$ is the negative period, applying, between the aluminum support and the opposite electrode, an alternating current including periods in which the current reaches peak levels in the positive period $t_F$ and the negative period $t_R$, respectively, being adjusted in the range of 0.1–20% of either period.

An acid electrolytic liquid according to the present invention is a liquid mainly containing nitric acid or hydrochloric acid. A preferable concentration of the nitric acid is in the range of 5–50 g/l and a preferable concentration of aluminum in the electrolytic liquid is in the range of 2–20 g/l. On the other hand, a preferable concentration of the hydrochloric acid is in the range of 5–100 g/l and a suitable concentration of aluminum is in the range of 2–30 g/l. Also, it is preferable for uniform graining that the electrolytic current be supplied by a current density in the range of 10–80 A/dm$^2$ and the temperature of the electrolytic liquid be above 30° C. Additionally, the concentration of aluminum in the electrolytic liquid is caused by eluting constituents from the aluminum plate by the reaction of the anode, or caused by adjusting the density of nitric aluminum, or the like, as desired.

According to the present invention, preferably a frequency of electrolytic current for mass-production is in the range of 10–100 Hz.

DETAILED DESCRIPTION OF THE PREFERRED EMBODIMENTS OF THE INVENTION

Figure 1:
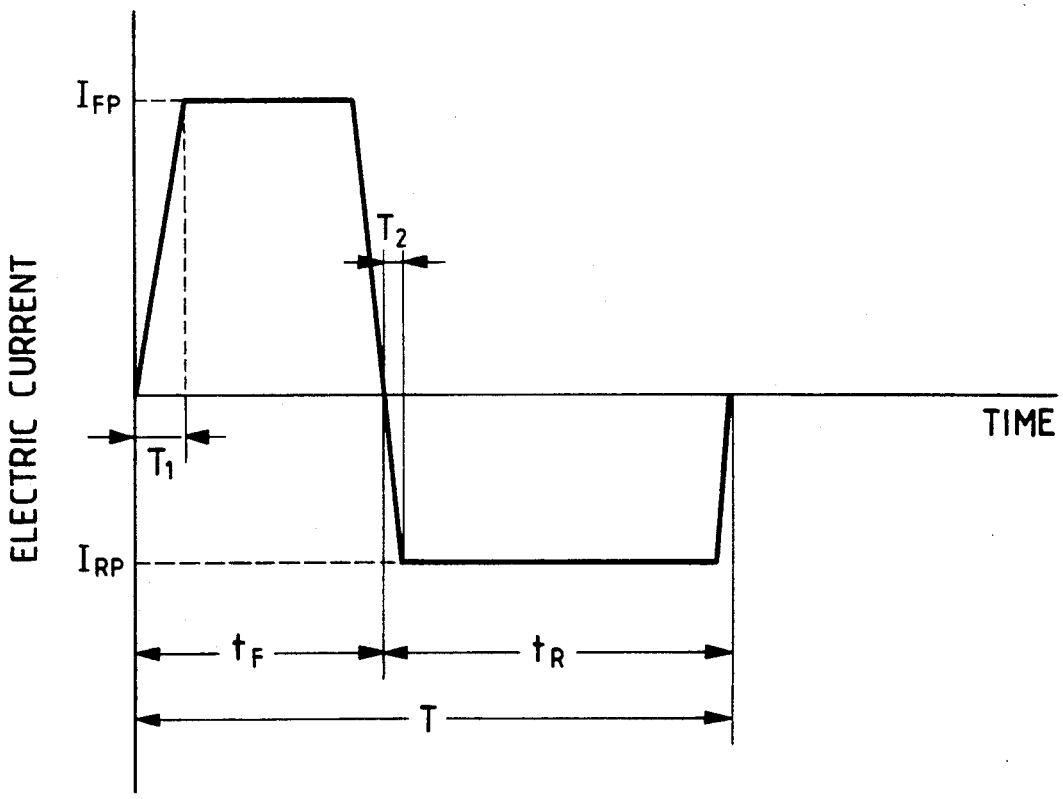
FIG. 1 is a graph showing one example of an alternating waveform for describing the conditions of the present invention.

This invention will now be described in detail.

First of all, an aluminum support is etched by an alkaline. A preferable alkaline agent includes caustic soda, caustic potash, metasilicate soda, sodium carbonate, aluminate soda, gluconate soda or the like. It is preferable that a concentration of the alkaline agent is in the range of 0.01–20%, a temperature of the etching liquid is in the range of 20°–90° C. and an etching period is in the range of 5 secs. to 5 mins. Also, a preferable etching amount is in the range of 0.01–5 g/m$^2$, and regarding an aluminum support containing a relatively large amount of impurities of manganese or the like, a preferable etching amount is in the range of 0.01–1 g/m$^2$.

Additionally, if an insoluble smut remains on the surface of the aluminum plate, a desmut treatment may be performed, if necessary.

After pre-treatment as described above has been performed, the aluminum plate is electrochemically grained in an acid electrolytic liquid using an alternating current.

An acid electrolytic liquid according to the present invention may include a liquid mainly containing nitric acid or hydrochloric acid. A concentration of the nitric acid is in the range of 3-150 g/l, more preferably 5-50 g/l, and a concentration of aluminum is not larger than 50 g/l, more preferably in the range of 2-20 g/l. On the other hand, a concentration of the hydrochloric acid is in the range of 2-250 g/l, more preferably 5-100 g/l, and a concentration of aluminum is not larger than 50 g/l, more preferably in the range of 2-30 g/l. It is possible to add an additive such as ammonium ion, but with use of such additive, it is difficult to carry out concentration control of the liquid for mass-production. Also, it is preferable to supply the electrolytic current at a current density in the range of 5-100 A/dm$^2$, more preferably 10-80 A/dm$^2$. However, it is possible to select the above-described conditions according to an electricity quantity, a desired quality, a composition of the aluminum support, and the like.

Furthermore, the electric current waveform is selected in an inductance component and the like of an electric source, a busbar and an electrolytic cell. However, it is necessary that periods in which the current reaches peak levels in the positive period $t_F$ and the negative period $t_R$, respectively, are adjusted or reached in the initial range of 0.1-20% of either period.

The invention will now be described with reference to FIG. 1. An alternating waveform shown in FIG. 1 is used as a current waveform. Assuming that $I_{FP}$ is the peak level in the positive period, $I_{RP}$ is the peak level in negative period, $T_1$ is the period from a current of zero to peak level $I_{FP}$, and $T_2$ is the period from a current of zero to peak level $I_{RP}$. Periods of the present invention are represented as:

$$t_F \times 0.001 < T_1 < t_F \times 0.2$$

$$t_R \times 0.001 < T_2 < t_R \times 0.2$$

The frequency is given as:

$$f = 1/T = 1/(t_F + t_R)$$

As a result of causing periods $t_F$ and $t_R$ to meet the above conditions, a dissolving reaction on the anode and a smut producing reaction on the cathode are effectively conducted to produce uniform pits. Regarding periods $t_F$ and $t_R$, though the above method is effective to reduce an inductance component of the electric source and the electrolytic cell as much as possible, in the case where an electric source of a large capacity is required for mass-production, the inductance component is inevitably increased due to enlargement of the electric source apparatus. For dealing with the inductance component, there is provided a method which forces the source voltage to be overworked to reduce periods $t_F$ and $t_R$ of the current waveform.

Under such a condition, pits having a diameter of 0.5-3 μm and a depth of 0.3-3 μm are formed.

Subsequently, it is preferable to treat the graining aluminum in an acid or alkaline liquid. The preferable liquid may include phosphoric acid or mixture of phosphoric acid and chromic acid, as well as sulfuric acid described in Japanese Patent Examined Publication No. 56-11316. An alkaline liquid such as a caustic soda described in Japanese Patent Examined Publication No. 48-28123 may be used to effect a weak etching treatment for removing the smut from the surface of the grained aluminum. In the case of removing smut by an alkaline liquid, insoluble ingredients remain in the alkaline liquid since the aluminum surface is etched. It is, therefore, necessary to carry out a de-smut treatment in an acid solution, e.g., sulfuric acid, phosphoric acid, chromic acid or the like.

It is preferable that an oxidized surface of the anode have an amount of 0.1-10 g/m$^2$, more preferably 0.3-5 g/m$^2$. Also, it is suitable to carry out the alkaline-etching and the de-smut treatment before the oxidizing treatment.

As to conditions for oxidizing the anode, although it is not possible absolutely to determine the treatment conditions because the conditions are subject to change according to the kind of electrolytic liquid, it is suitable that the electrolytic liquid be prepared with the conditions of a concentration of 1-80 wt %, a temperature of 5°-70° C., a current density of 0.5-60 A/dm$^2$, a voltage of 1-100 V, and an electrolytic period to be within a range of 1 sec. to 5 mins.

An aluminum plate having an oxidized surface anode according to the above method has a hydrophilic property. Therefore, it is possible to apply a photosensitive coat directly to the plate, and it is possible to apply a further surface treatment to the plate. For example, it is possible to apply to the plate a silicate coat of alkali metal silicate or an undercoating of hydrophilic polymer compound. A preferable amount of the applied undercoating is in the range of 5-150 mg/m$^2$.

Finally, a photosensitive coat is applied onto the aluminum support treated according to the above methods, and subsequently thereto, various treatments such as exposing, developing, photoengraving and printing are carried out in series.

EXAMPLE

Examples according to the invention will be described in detail as follows. However, it should be noted with respect to such exemplary embodiments that the invention is not limited thereto or thereby.

EXAMPLE 1

An aluminum support such as JIS 3103 material was soaked in a solution including 10% caustic soda warmed at 50° C., so that an aluminum was dissolved in the solution with an amount of 3 g/m$^2$ during the etching treatment. Subsequently, treatments such as removing smut from the aluminum support, and washing the aluminum support with water, were performed in series. Furthermore, the treated aluminum support was soaked in a solution at 50° C. including nitric acid of 13 g/l and added aluminum ion of 4 g/l. The conditions of the electrolytic graining in the solution were as follows: periods $t_F = t_R$, in the respective driving frequencies of 10, 30, 50, 80 and 100 Hz, the electricity quantity in a positive period being 200 C/dm$^2$, and the periods in which the current reach peak levels in the positive period $t_F$ and the negative period $t_R$, respectively, being at 0.1 msec, 1 msec and 2 msec as the result of adjusting the alternating voltage of electrolysis so as to keep the periods in the range of $t_F/1000$-$t_F5$, $t_R/1000$-$T_R/5$, respectively. Combinations of the conditions are disclosed in the following Table 1.

TABLE 1

| $T_1 = T_2$ Frequency ($t_F = t_R$) | 0.1 msec | 1 msec | 2 msec |
|---|---|---|---|
| 10 Hz (50 msec) | A | F | K |
| 30 Hz (16.7 msec) | B | G | L |
| 50 Hz (10 msec) | C | H | M |
| 80 Hz (6.3 msec) | D | I | — |
| 100 Hz (5 msec) | E | J | — |
| 10 Hz ($t_F$ = 40 msec) $t_R$ = 60 msec) | N | O | P |

The samples were marked A–P, respectively. Subsequent to electrolytic treating and a removing of the smut from the surface of the aluminum plate, the surface was observed using electrophotography. Subsequently, an oxidized surface of the anode was formed using an amount of 2.5 g/m$^2$ in a solution including 20% sulfuric acid, was washed with water, and was dried. Also, these treated samples were marked [A]–[P], respectively, as base plates.

COMPARATIVES

1. An aluminum support such as JIS 3103 material was soaked in a solution including 10% caustic soda warmed at 50° C., so that an aluminum was dissolved in the solution with an amount of 3 g/m$^2$ during the etching treatment. Subsequently, treatments such as removing smut from the aluminum support, and washing the aluminum support with water, were performed in series. Furthermore, the treated aluminum support was soaked in a solution at 50° C. including nitric acid of 13 g/l and added aluminum ion of 4 g/l. The conditions of the electrolytic graining in the solution were as follows: periods $t_F = t_R$, in the respective driving frequencies of 10, 30, 50, 80 and 100 Hz, the electricity quantity in a positive period being at 200 C/dm$^2$, and the periods in which the current reach peak levels in the positive period $t_F$ and the negative period $t_R$, respectively, being at 2 msec, 5 msec and 11 msec as the result of adjusting the alternating voltage of electrolysis so as to keep the periods over $t_F/5$, and $t_R/5$, respectively. Combinations of the conditions are disclosed in following Table 2.

TABLE 2

| $T_1 = T_2$ Frequency ($t_F = t_R$) | 2 msec | 5 msec | 11 msec |
|---|---|---|---|
| 10 Hz (50 msec) | — | — | R |
| 30 Hz (16.7 msec) | — | U | — |
| 50 Hz (10 msec) | — | Q | — |
| 80 Hz (6.3 msec) | S | — | — |
| 100 Hz (5 msec) | T | — | — |

The samples were marked Q–U, respectively. Subsequent to the electrolytic treating and a removing of the smut from the surface, the surface of the aluminum plate was observed using electrophotography. Subsequently, an oxidized surface of the anode was formed using an amount of 2.5 g/m$^2$ in a solution including 20% sulfuric acid, was washed with water, and was dried. Also, these treated samples were marked [Q]–[U], respectively, as base plates.

The base plates [A]–[U] treated by the above methods were formed, respectively, with photosensitive layers of 2.5 g/m$^2$ dry weight including the following components on the surface.

| | |
|---|---|
| Ester compounds of naphthoquinone-1, 2-diazide-5-sulfonylchloride with pyrogallol or acetone resin (disclosed in example 1 of U.S. Pat. No. 3,635,709) | 0.75 g |
| Cresolnovolak resin | 2.00 g |
| Oil blue #603 (product of Orient Chemical Co., Ltd.) | 0.04 g |
| Etylenedichloride | 16 g |
| 2-methoxyethyl acetate | 12 g |

The photosensitive lithograph printing plates according to the above treatments were exposed to light from a 3 kw metal-halide lamp with 1 m distance therefrom through a transparent positive film during 50 seconds, and were developed in the solution (ph = 12.7) including silicic sodium of 5.26% with a moll ratio 1.74 between $S_1O_2$ and $Na_2O$. Finally, the printing plates were used in a well-known printing process.

In the printing, a "Sprint 25" (product of Komori Printer Company) was used. Also, the appraisal of the printing and conditions of graining surface are disclosed in the following Table 3.

Additionally, in the Table 3, symbol ◎ means an excellent printing performance with strong stain-proof, symbol ○ means excellent printing performance with stain-proof, symbol ○Δ means practical use performance with stain-proof, symbol Δ means narrow practical use performance, symbol Δx means non-practical use performance and symbol x means non-practical use and easy staining performance.

TABLE 3

| | | stain-proof | surface condition |
|---|---|---|---|
| EXAMPLES | A | | uniformity |
| | B | Δ | " |
| | C | ○ | " |
| | D | | " |
| | E | Δ | " |
| | F | Δ | " |
| | G | Δ | " |
| | H | | " |
| | I | Δ | " |
| | J | Δ | " |
| | K | Δ | fairly uniform |
| | L | Δ | " |
| | M | Δ | " |
| | N | | uniformity |
| | O | ○ | " |
| | P | | " |
| COMPARATIVES | S | Δx | ununiformity |
| | T | x | " |
| | U | Δx | " |
| | Q | x | " |
| | R | x | " |

As the result of the above, it can be seen that it was possible for the examples of the present invention uniformly to grain the aluminum support, also it was possible to obtain an excellent printing without stain capabilities for the printing plate produced by the present invention.

In the case of electrochemical graining an aluminum support by alternating current, it is possible uniformly to grain a support by means of the alternating current of the present invention. Also, it is possible to obtain a support providing lo fine printing performance with uniform pits against the irregular yield of aluminum alloy ingredients.

What is claimed is:

1. A method of producing an aluminum support for a printing plate by electrochemical graining, said method comprising the steps of:

soaking said aluminum support in an acid electrolytic liquid; and assuming that $t_F$ is a positive period of an alternating current and $t_R$ is a negative period of an alternating current, applying, between the aluminum support and an opposite electrode, an alternating current including periods in which current reach peak levels in the positive period $t_F$ and the negative period $t_R$, respectively, are reached within the initial range of 0.1-20% of either period.

2. A method according to claim 1, in which said electrolytic liquid includes nitric acid in the range of 3-150 g/l, and aluminum being not larger than 50 g/l.

3. A method according to claim 2, in which said electrolytic liquid includes nitric acid in the preferred range of 5-50 g/l, and aluminum being in the preferred range of 2-20 g/l.

4. A method according to claim 1, in which said electrolytic liquid includes hydrochloric acid in the range of 2-250 g/l, and aluminum being not larger than 50 g/l.

5. A method according to claim 4, in which said electrolyte liquid includes hydrochloric acid in the preferred range of 5-100 g/l, and aluminum in the preferred range of 2-30 g/l.

6. A method according to claim 1 in which said current is supplied with a current density in the range of 10-80 A/dm$^2$.

7. A method according to claim 1 in which a temperature of said electrolytic liquid is above 30° C.

8. A method according to claim 1 in which a frequency of said current is in the range of 10-100 Hz.

* * * * *